United States Patent [19]

Brosillon

[11] Patent Number: 4,529,913

[45] Date of Patent: Jul. 16, 1985

[54] DEVICE FOR CONTROLLING THE LIGHT INTENSITY OF A FLUORESCENT TUBE FED FROM A D.C. VOLTAGE

[75] Inventor: Raymond M. Brosillon, Goussainville, France

[73] Assignee: Precision Mecanique Labinal, France

[21] Appl. No.: 675,451

[22] Filed: Nov. 27, 1984

Related U.S. Application Data

[63] Continuation of Ser. No. 440,084, Nov. 8, 1982, abandoned.

[30] Foreign Application Priority Data

Nov. 9, 1981 [FR] France ..... 81 20906

[51] Int. Cl.[3] ..... H05B 37/02

[52] U.S. Cl. ..... 315/224; 315/291; 315/DIG. 4; 315/DIG. 7

[58] Field of Search ..... 315/291, DIG. 4, DIG. 7, 315/224, 306; 363/41

[56] References Cited

U.S. PATENT DOCUMENTS

| | | | |
|---|---|---|---|
| 3,890,537 | 6/1975 | Park et al. | 315/208 |
| 4,039,897 | 8/1977 | Dragoset | 315/DIG. 7 |
| 4,170,747 | 10/1979 | Holmes | 315/307 |
| 4,219,760 | 8/1980 | Ferro | 315/DIG. 4 |
| 4,251,752 | 2/1981 | Stolz | 315/DIG. 4 |
| 4,277,728 | 7/1981 | Stevens | 315/DIG. 5 |
| 4,346,332 | 8/1982 | Walden | 315/307 |
| 4,492,899 | 1/1985 | Martin | 315/DIG. 7 |

*Primary Examiner*—Harold Dixon

*Attorney, Agent, or Firm*—Larson and Taylor

[57] ABSTRACT

A device for controlling the luminous intensity of a fluorescent tube supplied with a direct voltage comprises a stabilized supply, a ramp generator, a modulator receiving the ramp signal responsive to a control means sending thereto a voltage for generating a chopped signal whose chopping rate is determined by the control means. The signal is sent to the converter of the tube through an interface circuit. The device is applicable to the regulation of the intensity of tubes on an airship, automobile or portable lamp.

10 Claims, 2 Drawing Figures

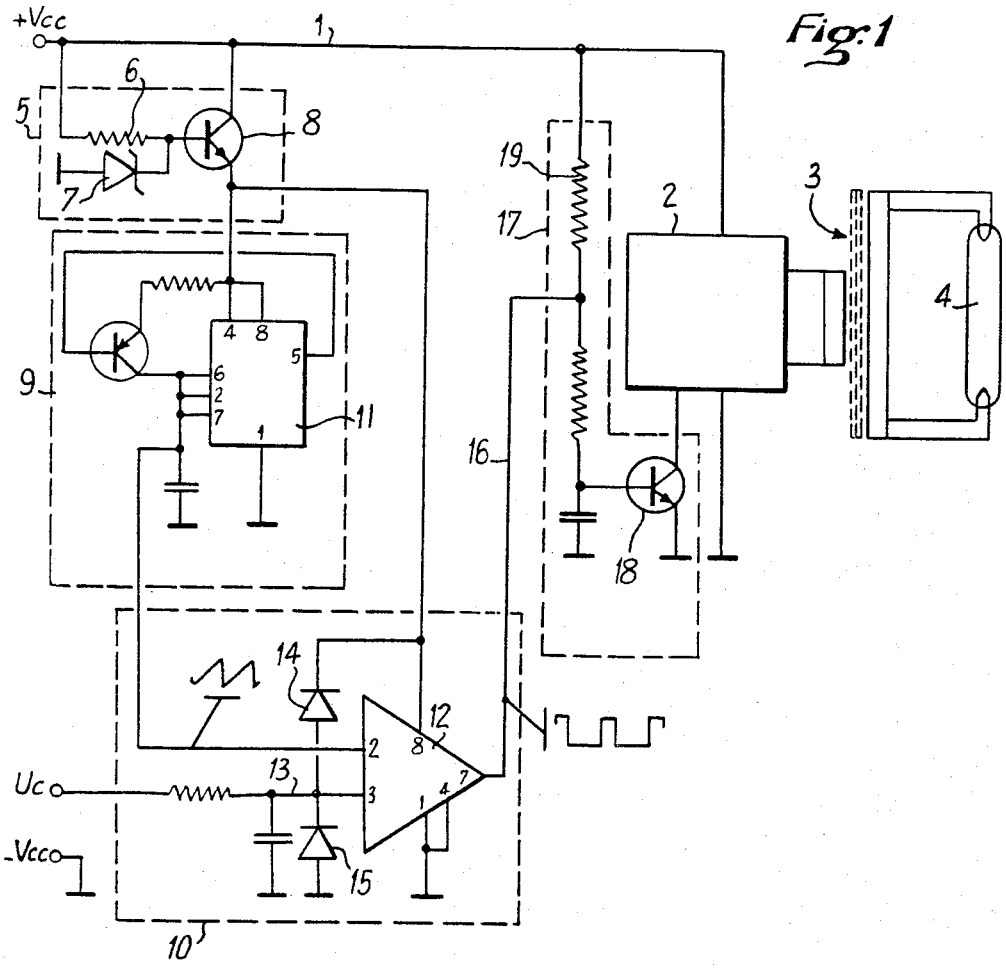
Fig:2
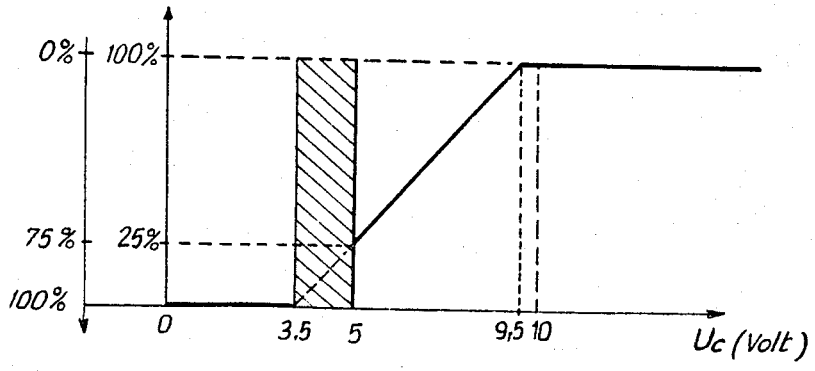

DEVICE FOR CONTROLLING THE LIGHT INTENSITY OF A FLUORESCENT TUBE FED FROM A D.C. VOLTAGE

This application is a continuation, of application Ser. No. 440,084 filed 11/8/82 now abandoned.

The present invention relates to a device for controlling the luminous intensity of a fluorescent tube supplied with a direct voltage as, for example, a fluorescent illuminating tube of an airship, an automobile or a portable lamp working off a battery.

It is known that, for the supply of fluorescent tubes from a DC network, converters are used which are supplied by the network and usually comprises a power oscillator whose output is connected to the primary winding of a transformer whose secondary winding is connected to the tube. The restrictions imposed by the operation of the fluorescent tube in practice do not allow the control of the luminous intensity of the tube by a modification of the supply conditions. Now, it is highly desirable to be able to control and modify the luminous intensity of a fluorescent illuminating tube supplied from a DC network in many applications.

There has already been described in patent application PCT/81/00184 a process for controlling a fluorescent lamp supplied with direct current, in which, for the purpose of reducing the luminous intensity, the mean value of the duration of pulse trains is decreased by piloting a transistorized switch which interrupts and allows in an alternating manner the supply of the converter of the lamp. Such an arrangement is complicated and is not easily applicable to the case of the control of a plurality of lamp ballasts by the same control voltage.

There has also been described, in U.S. Pat. No. 4,251,752, a variable cyclic ratio control but which is applied directly to the operating frequency of the ballast, with the associated drawbacks.

An object of the present invention is consequently to provide a device for controlling the luminous intensity of a fluorescent tube supplied from a direct voltage, which is capable of being adapted to all the needs of the user and to many different configurations of converters.

Another object of the invention is to provide such a device which is capable of employing control means which are simple, easy to arrange, but little sensitive to parasites and non-disturbing.

Yet another object of the invention is to provide such a device which while it is capable of being adapted to many types of converters, conserves an acceptable efficiency even at a low rate of operation, i.e. for low values of the luminous intensity.

A still further object of the invention is to provide such a device which is simple and cheap in construction.

The invention has for subject a device for controlling the luminous intensity of a fluorescent tube supplied from a direct voltage through a converter, in which the duration of voltage pulses allowing the ignition of the tube is varied, characterized in that it comprises a control means and means for generating a chopped signal with a chopping rate determined by said control means, said chopped signal being sent to a responsive element of the converter so as to block temporarily and in a repeated manner said converter at the rhythm of said chopped signal.

Advantageously, the blocking of the converter at a variable cyclic ratio thus achieved is effected at low frequency, which facilitates the adaptation to many types of converters and permits retaining an acceptable efficiency even at a reduced rate of operation.

The repetitive blocking of the converter results in a corresponding blocking of the fluorescent tube in a brief and repetitive manner, the variation in the luminous intensity thus occurring without visual inconvenience, without flashing and without stroboscopic effect.

In a preferred embodiment, the control means is a means permitting the establishment of a direct control voltage, for example a variable potentiometer. This potentiometer may be supplied for example from the direct voltage supply of the network and has at least two positions, namely a position permitting the operation at full power of the fluorescent tube and a position allowing only operation at low power.

The device then comprises advantageously a ramp generator and a modulator mainly comprising a comparator one of the inputs of which receives the signal from the ramp generator whereas there is introduced on its other input said direct control voltage so as to generate a chopped signal of constant potential whose chopping rate varies as a function of the value of the introduced control potential, the chopping rate being zero when this potential is equal to the peak potential of the ramp generator and becoming greater as this potential is decreased. The chopped signal issuing from the modulator is advantageously sent to a converter blocking circuit. The latter may advantageously comprise a transistor whose base receives the chopped signal and which permits, when it is thus rendered conductive, earthing a power transistor of the converter, for example a transistor of a power oscillator of the converter.

Preferably, the device comprises a supply circuit stabilized by the D.C. network so as to permit a stable operation of the whole over a wide range of variation of the supply voltage of the network.

According to an improvement of the invention, the control means may be so designed that it does not send a voltage lower than a certain threshold so as to avoid blocking the converter beyond the limit permitting a stable operation of the fluorescent tube.

Further advantages and features of the invention will be apparent from the reading of the ensuing description which is given by way of a non-limiting example with reference to the accompanying drawing in which:

FIG. 1 represents a diagram of a device according to the invention.

FIG. 2 represents a graph of the device according to the invention.

The supply line 1 of the dc network at voltage +Vcc, for example 25 volts, supplies power to a converter of a fluorescent tube comprising a usual power oscillator 2, for example constructed around a single transistor whose collector is charged by the tuned primary winding of a leak transformer 3, the secondary winding of the transformer comprising high tension and heating windings of the fluorescent tube 4, the choke of the high-tension winding performing the function of current regulating ballast in the tube. The oscillator is for example designed to have an operating frequency of the order of 80 kHz so as to reduce the size of the large components such as capacitors and transformers.

The control device according to the invention comprises first of all a supply circuit 5 stabilized for example at 15 volts with a resistor 6, a 15 volt Zener diode 7 and a transistor 8 whose emitter delivers the stabilized voltage of 15 volts. The latter supplies a ramp generator generally designated by the numeral 9 and a modulator generally designated by the numeral 10.

The ramp generator, which is of usual type, comprising in particular an integrated circuit, for example of the type 555, sold by National Semi-Conductor, and set to 200 Hz, is connected to the input (2) of a comparator 12 which is part of the modulator 10. The other input (3) of the comparator receives a conductor 13 in which may be introduced a variable direct voltage Uc by a suitable control means (not shown), for example a system having three positions, namely stop, operation at 100% and operation at 25%. The input (3) of the comparator 12 is filtered by an RC circuit and protected by two diodes 14, 15. The output 16 of the comparator is connected to a blocking interface 17 of the oscillator comprising in particular a transistor 18 whose collector is connected to the base of the power transistor (not shown) of the oscillator 2 so that, when the required voltage is applied to the base of the transistor 18, the latter is conductive and earths the transistor of the oscillator 2. Advantageously, the blocking circuit 17 may be connected to the supply network 1 through a resistor 19 and also comprise RC filtering means.

The operation is then as follows:

When the voltage Uc applied by the control means is lower than the initial potential of the ramp (3.5 V), i.e. if $Uc<3.5$ V, the comparator 12 generates a constant voltage at its output 16 irrespective of the ramp potential which is always $>3.5$ V. Under these conditions, the base of the transistor 18 is constantly excited and the transistor 18 is rendered and maintained conductive. The power oscillator consequently cannot operate and the fluorescent tube remains extinguished. If thereafter, there is applied by the control means a voltage Uc higher than 9.5 V, the final ramp potential, for example 10 V or more, the output 16 of the comparator generates no signal. The chopping rate is zero, the power oscillator operates permanently and the fluorescent tube is supplied at 100%.

If thereafter there is introduced an intermediate voltage Uc, for example 25% (5 V), the comparator 12 will emit a chopped signal whose chopping rate, i.e. the ratio of the duration of zero potential of the signal to the total duration of the signal, i.e. the period of the ramp, will be $\frac{1}{4}$. This signal sent by the conductor 16 to the transistor 18 will thus block the converter at a frequency of 200 Hz during each time the $\frac{3}{4}$ of the period corresponding to this frequency. Consequently, the luminous intensity in the fluorescent tube will be about $\frac{1}{4}$ of the maximum intensity.

Of course, the invention may have many variants. First of all, the control means adapted to introduce a control potential of Uc may be piloted manually, or, on the contrary, under the control of some system. It may be constituted very simply by a switch having three positions permitting the setting for example of zero potential, a potential exceeding 100% of the peak of the ramp and an intermediate potential, for example at 25%. It may also be constituted by a mechanically controlled potentiometer which may be set at discrete values or, on the contrary, varied in a continuous manner. It may also be constituted by an electronic circuit permitting the introduction of a given potential Uc as a function of a manual or automatic instruction.

The other illustrated electronic means may also be replaced by equivalent means available to one skilled in the art. The interface 17 will be constructed as a function of the nature and characteristics of the converter it must pilot, the interface 17 possibly being advantageously constituted by an interchangeable or adjustable module.

Further, it is of interest, according to the invention, to prevent the illumination of the fluorescent tube for high chopping rates, for example higher than 75%, i.e. for values at which the stable operation of the fluorescent tube can no longer be ensured. This may be achieved for example by rendering the input (3) of the comparator 12 only responsive to a potential which is equal to or higher than 5 V so as to obtain a forbidden zone shown by the cross-hatching in FIG. 2.

I claim:

1. A device for controlling the luminous intensity of a fluorescent tube supplied with a direct current voltage through a converter, which produces voltage pulses at a first frequency, for providing the ignition of the tube, characterized in that the device comprises a control means for providing a control signal, means responsive to said control signal for generating a chopped signal at a second frequency and having a duty cycle determined by the control signal provided by said control means, and blocking means associated with the converter and responsive to said chopped signal for blocking said converter temporarily and in a repetitive manner.

2. A device according to claim 1, characterized in that the control means comprises means for providing a direct current control voltage.

3. A device according to claim 2, characterized in that the central means comprises a variable potentiometer.

4. A device according to claim 2, characterized in that the control means is supplied from the direct voltage supply of the network.

5. A device according to claim 1, characterized in that said device comprises inhibiting means for preventing the generation of said chopped signal so as long as the duty cycle thereof has a high value incompatible with a stable operation of the fluorescent tube.

6. A device for controlling the luminous intensity of a fluorescent tube supplied with a direct current voltage through a converter, which produces voltage pulses at first frequency, for providing the ignition of the fluorescent tube, characterized in that the device comprises a control means for providing a control signal means responsive to said control signal for generating a chopped signal at a second frequency and having a duty cycle determined by the control signal provided by said control means, blocking means, associated with the converter and responsive to said chopped signal, for blocking said converter temporarily and in a repetitive manner, said control means comprising means for providing a direct current control voltage, said device further comprising a ramp generator for generating a ramp voltage, and said means for generating a chopped signal comprising a modulator having a first input for receiving the ramp signal of the ramp generator and a second input for receiving said direct current voltage produced by said control means.

7. A device according to claim 6, characterized in that the modulator comprises a comparator whose output signal having a chopping rate which is variable as a function of the value of the direct current voltage relative to the ramp voltage.

8. A device according to claim 7, characterized in that said blocking means comprises a blocking circuit forming an interface for the converter.

9. A device according to claim 8, characterized in that said blocking circuit comprises a transistor connected between ground and the power converter, the base of the transistor receiving the chopped signal.

10. A device for controlling the luminous intensity of a fluorescent tube supplied with a direct current voltage through a converter, which produces voltage pulses at a first frequency, for providing ignition of the fluorescent tube, characterized in that the device comprises means for generating a periodic signal; means for generating a control signal; comparator means for comparing said periodic signal and said control signal and for generating a first signal when said control signal is less than the lowest value of said periodic signals, for generating a second signal when said control signal is greater than the greatest value of said periodic signal, and for generating a third signal for values of said periodic signal between said lowest and greatest values, said third signal being a chopped signal whose frequency corresponds to the frequency of said periodic signal and whose duty cycle is a function of the comparative values of said periodic signal and said control signal; and blocking means associated with said converter for blocking the output of the converter responsive to said first signal, for enabling the output of the converter responsive to said second signal, and for intermittently blocking the output of the inverter, responsive to said third signal.

* * * * *